US007193168B1

(12) United States Patent
Gilliland et al.

(10) Patent No.: US 7,193,168 B1
(45) Date of Patent: Mar. 20, 2007

(54) PNEUMATIC SWITCH FOR NON-INVASIVE TESTING AND DEBUG

(75) Inventors: Don Alan Gilliland, Rochester, MN (US); Dennis James Wurth, Rochester, MN (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 11/272,582

(22) Filed: Nov. 10, 2005

(51) Int. Cl.
*H01H 35/24* (2006.01)

(52) U.S. Cl. ..... 200/81 R; 200/83 R

(58) Field of Classification Search .... 200/81 R–83 Z, 200/81.4, 81.5, 547–552
See application file for complete search history.

(56) References Cited

U.S. PATENT DOCUMENTS 3,982,225 A * 9/1976 Schlanzky ..... 340/442
4,123,630 A * 10/1978 Mac Intyre et al. ..... 200/52 R
5,139,357 A * 8/1992 Reents ..... 401/146

* cited by examiner

*Primary Examiner*—Michael Friedhofer
*Assistant Examiner*—Lisa Klaus
(74) *Attorney, Agent, or Firm*—Robert W. Lahtinen

(57) ABSTRACT

A pneumatic switch includes a housing which presents external contacts spaced apart to engage a component site on a device such as a circuit board. A pair of components are supported on the switch housing. A flexure mounted armature or vane is biased in one direction to electrically connect one of the pair of mounted components serially between the housing external contacts, while an air flow to the switch displaces the vane to electrically connect the other of the pair of components in series between the external contacts. The electrical leads between each of the pair of components and the external contacts are of equal length. The switch external contacts may also engage the terminals of a component at a circuit site to insert the mounted components alternatively in parallel with the existing component.

10 Claims, 3 Drawing Sheets

PNEUMATIC SWITCH FOR NON-INVASIVE TESTING AND DEBUG

FIELD OF THE INVENTION

The present invention is directed to pneumatically operated switches and more particularly to a pneumatically operated switch assembly to alternatively switch out electrical components in a circuit without powering down the circuit or providing an alternate path for the escape of emissions.

BACKGROUND OF THE INVENTION

Early in the design cycle of an electronic product, it is important to verify the signal integrity of specific critical signals for proper function and to measure the radiated electromagnetic emissions from that product to ensure compliance with legally mandated requirements. During these measurements, the value of series and parallel termination and filter components may be changed in order to improve the signal operation and improve the radiated emissions profile. It is also useful to remove the termination components and add them back individually or additively during emissions debug to identify an offending signal or combination of signals. Currently, this is done by physically removing and replacing these components via hand soldering operations. A substantial drawback to this approach is the time required to shut the system down, tear it apart, reassemble and reboot. Each iteration of this is time consuming on any product and in some instances can take hours. In addition to this, the emission profile of any product can be altered simply by the assembly and disassembly of the product, which adds an undesirable variable to this experimental procedure.

SUMMARY OF THE INVENTION

The present invention, as shown and described, provides a means to change out multiple components and to remotely switch between different values or types of components via the actuation of a pneumatic switch. The major advantages of this invention are the ability to change out components without powering the product down and the ability to remotely switch between different component values without disassembling the product. Note that the components can also be switched out of the circuit if desired. The use of air pressure instead of electrical switching was chosen because the electrical wires required for activating the switches would add a path for emissions to escape the enclosure that would complicate the measurements. It should be understood that for this application, air or pneumatic switching would be the best choice, but alternate methods of switching, magnetic, electrical, etc. could be used for applications whereby the components switched in may be controlled by the circuitry itself for changes in values to select or optimize the circuit. It should also be understood that in this instance resistors are chosen to select minimization of ringing characteristics of the circuit whereby capacitors, diodes, electromagnetic interference (EMI) filters, inductors, crystals, ferrite surface mount parts, or any of a multitude of circuit devices may be switched in or out of the circuit for the purpose of debugging or for circuit self-selection of an optimal part.

The invention comprises an assembly that will solder to typical surface mount pads. The assembly is fitted with two sockets capable of holding two surface mount components within spring contacts connected to a double throw double pole pneumatic switch. This switch, as shown and described, is configured to stay in a normally closed state to connect one component and then positive air pressure switches to the other component allowing for two states of operation without requiring negative air pressure. The switch could also be configured to stay in an always open state that switches from one component to the other by the use of positive or negative air pressure in order to achieve three states of operation. The described embodiment shows a configuration which would allow many of these switch assemblies to be placed side by side on a printed circuit board just as typical termination components would when placed as close as manufacturing constraints would allow.

DETAILED DESCRIPTION

Figure 1:
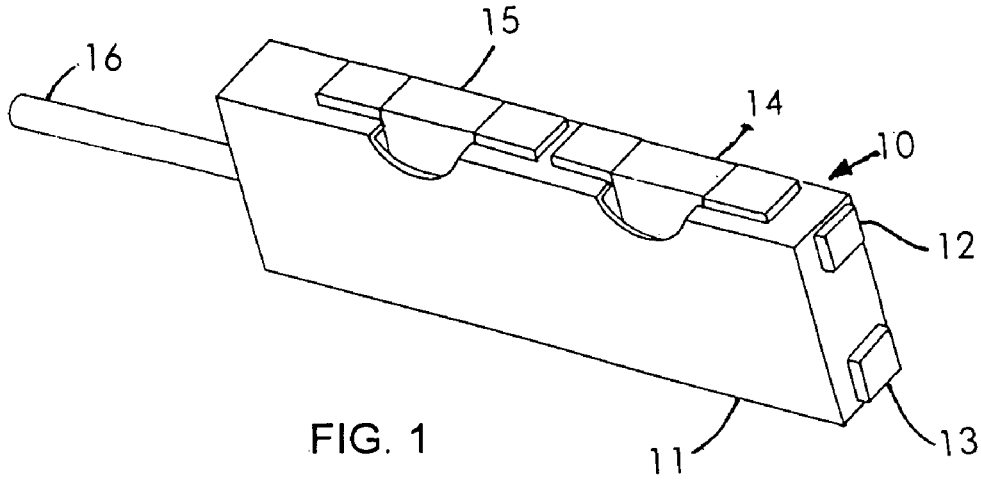
FIG. 1 is an exterior view, much enlarged, of the pneumatic switch of the present invention including components mounted in the sockets carried by the device.

FIG. 1 illustrates the pneumatic switch 10 of the present invention. The housing 11 supports a pair of contacts 12 and 13 at one end which are electrically connected to the terminals at a component mounting site on a circuit board or other electrical environment to which a component is attached. Two surface mount components 14 and 15 are mounted in sockets within the housing 11 and a tube 16, at the end opposite that supporting the contacts 12 and 13, is connected to an air supply to activate the switch to alternatively connect the components serially with the contacts 12 and 13.

The switch, as shown and described, is intended for the substitution of typical 0603 and 0805 surface mount components at surface mount sites. The typical length of the surface mount components 14 and 15 is about 3 mm. As such, the illustrations shown for purposes of description are much enlarged. The switch may be used either to alternatively connect the socket mounted components 14 and 15 at a surface mount site or the switch contacts 12 and 13 can be connected to the terminals of a component already mounted at the site to connect the switch mounted components alternatively in parallel within the component at the site.

Figure 2:
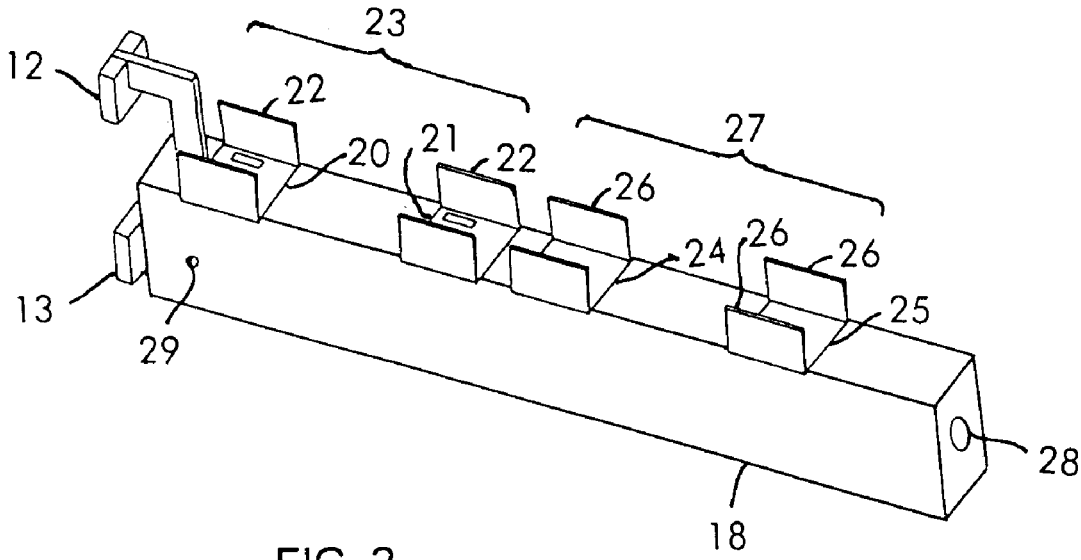
FIG. 2 shows a tubular enclosure that is disposed within the switch housing and the spring contacts supported thereon that form the component sockets.

FIG. 2 shows the tubular air chamber 18, supported within the housing 11, that both supports the elements forming the component sockets and serves to confine the switch activating air flow through the housing. The generally U-shaped metal conductors 20 and 21 form a socket 23 and present respective flange portions 22 that serve as spring clips supported on the tubular air chamber 18. The socket 23 serves to accept and retain a component to be inserted into a circuit by retaining the component electrical terminal end portions. The U-shaped conductors 24 and 25 and spring clip flange portions 26 form the component receiving and retaining socket 27 which electrically connects a second component to be selectively inserted into a circuit. As described below, these sockets are alternatively electrically connected between the contacts 12 and 13. The tubular air chamber 18 also serves as a duct to confine the switch activating air flow, that is introduced through the end opening 28, passes through the length of the tubular air chamber to exhaust openings 29 adjacent the opposite air chamber end. The delivery tube 16 enters the housing 11 and terminates at the air chamber opening 28.

Figure 3:
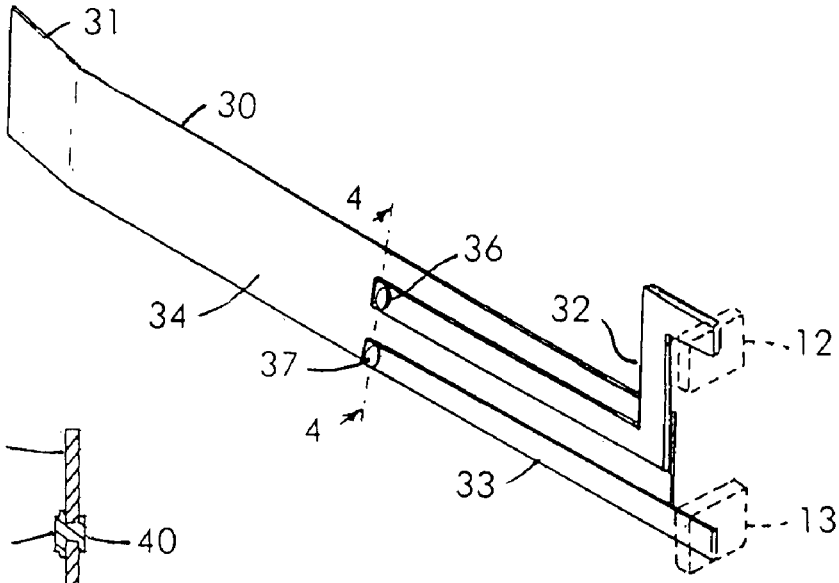
FIG. 3 is a view of the vane which is enclosed within the switch housing and the flat conductors which are partially secured to the vane.
Figure 4:
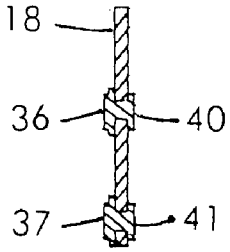
FIG. 4 is a section view taken along line 4—4 of FIG. 3 to illustrate the raised contacts carried by and presented at each major surface of the vane.
Figure 5:
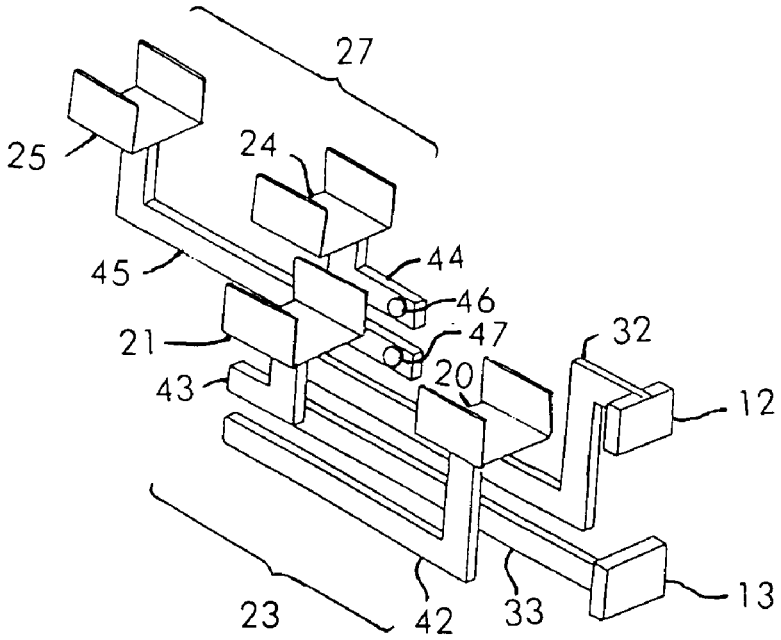
FIG. 5 is a laterally exploded view showing the electrically conductive elements of the switch.
Figure 6:
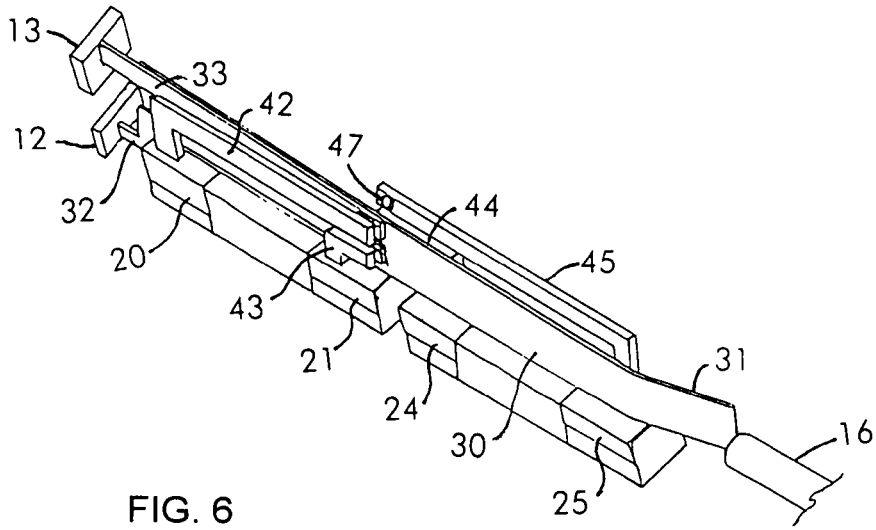
FIG. 6 is an inverted partial assembly including the elements of FIGS. 3 and 5 showing the structure that enables the switching operation.

FIGS. 3 and 4 illustrate the vane that is pneumatically displaced to alternatively switch components into a circuit. FIG. 5 shows the electrical conductor portions of the pneumatic switch and FIG. 6 is an inverted assembly of the vane and conductor portions of FIGS. 3 through 5.

The vane 30, shown in FIG. 3, is a flat resilient non-conductive member with a turned end portion 31. Flat conductors 32 and 33 are secured along the vane surface 34. Conductor 32 has a raised electrical contact 36 at one end and at the opposite end is terminated at the contact 12. Similarly, conductor 33 extends from a raised contact 37 at one end to the contact 13 at the opposite end. The conductors 32 and 33 are substantially coplanar and are respectively connected to the contacts 12 and 13. The vane 30 is supported within the tubular air chamber 18. As seen in FIG. 2, the conductor 32 extends through the top wall and conductor 33 extends through the end wall of the air chamber 18. Engagement of conductors 32 and 33 with the air chamber wall portions supports the vane assembly within the air chamber. The vane 30 is formed of a dielectric material such as Mylar and the conductors 32 and 33 are beryllium-copper to allow the resilient vane assembly to flex when air supplied through air chamber opening 28 engages the vane turned end portion 31. As shown in the section view of FIG. 4, the vane 30 has openings, beneath the raised contacts 36 and 37, that enable circular contacts 40 and 41 respectively, at the opposite surface of the vane, to be connected to the conductors 32 and 33.

FIG. 5 is a laterally exploded view of the electrical conductor portions of the pneumatic switch. The socket 23 has rigid conductors 42 and 43 extending respectively from the U-shaped conductors 20 and 21, with each of the conductors 42 and 43 presenting a contact surface (not visible) that confronts one of the contacts 36 and 37 (FIG. 3) on the conductors 32 and 33 adhered to the vane 30. Similarly, the socket 27 has rigid conductors 44 and 45 extending respectively from the U-shaped conductors 24 and 25 which present raised circular contacts 46 and 47 that respectively confront the contacts 40 and 41 (FIG. 4) on the vane 30.

As most clearly seen in FIG. 5, the electrical path from conductor 21, through conductor 43 and conductor 32, to contact 12 is the same length as the path from conductor 24, through conductor 44 and conductor 32, to contact 12. Likewise, the electrical path from conductor 20, through conductor 42 and conductor 33 to contact 13 is the same length as the path from conductor 25, through conductor 45 and conductor 33, to contact 13. Thus the length of the electrical leads remains the same from a component in either of sockets 23 or 27 associated with the switch.

The inverted partial assembly of the pneumatic switch in FIG. 6 contains the elements included in FIGS. 3 though 5 and illustrates the operation of the switch. The vane 30 is normally biased in one direction by the flexure portions of the vane and the conductors 32 and 33 to close the contacts between conductors 32 and 43 and the conductors 33 and 42. A component installed between conductors 20 and 21 in socket 23 is then connected serially between contacts 12 and 13. When a flow of air is introduced through tube 16 and engages turned end 31 of vane 30, the vane is deflected to electrically disengage socket 23 and electrically connect socket 27 which supports a component in conductors 24 and 25. Contact 13 is now connected through conductor 33, confronting contacts 41 (FIG. 4) and 47, and conductor 45 to U-shaped conductor 25. The other contact 12 is simultaneously connected through conductor 32 confronting contacts 40 (FIG. 4) and 46 (FIG. 5), and conductor 44 to U-shaped conductor 24.

Figure 7:
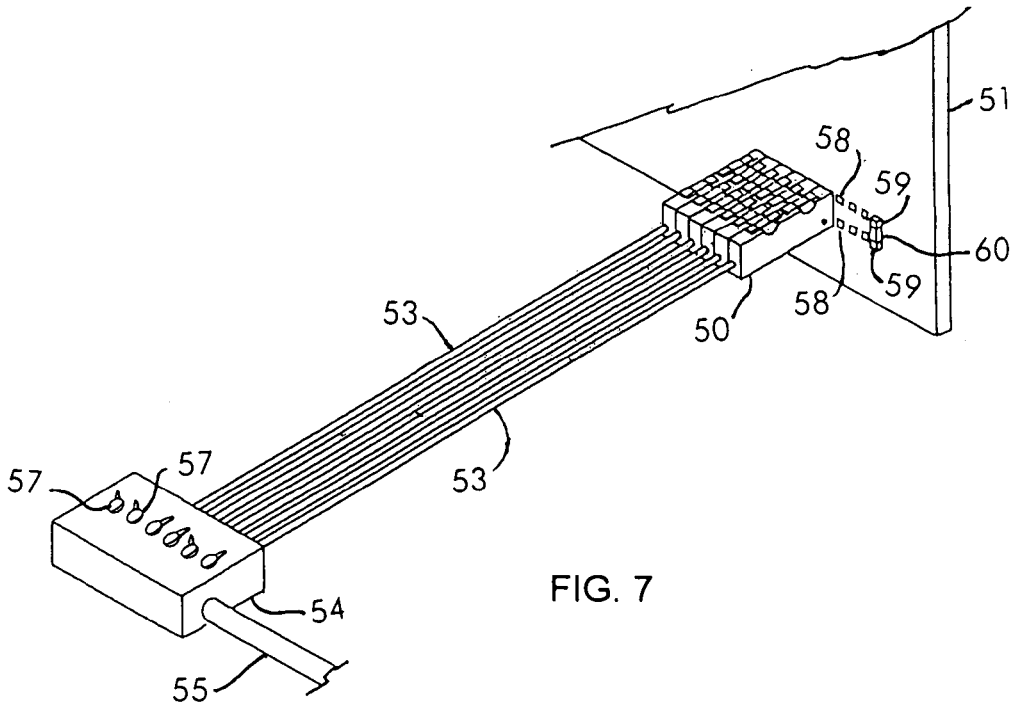
FIG. 7 illustrates an application of the pneumatic switch showing a bank of switches individually controlled to selectively and alternatively insert components on a circuit board.

FIG. 7 illustrates an application of the pneumatic switch shown and described above. In this environment, a bank 50 of six switches is connected to component sites on board 51, with each switch connected by a capillary tube 53 through a manually controlled valve in a manifold 54 to the source of air flow 55. Individual manual controls 57 enable or disable air supply through the respective capillary tubes to control which component is introduced at each site. As stated previously the switches of bank 50 may either be connected to component mounting pads 58 which form a component mounting site or be connected to the terminals 59 of a component 60, already mounted at the site, to cause the component inserted by the switch to be mounted in parallel with the component at the site.

As shown in FIG. 7 multiple pneumatic switches may be employed to permit concurrent manipulation of numerous component elements. Representative of other applications would be the concurrent swapping in and out of the two components mounted on a single switch to enable optimization in a single step using a wave form generator to apply a pulsed air supply to the pneumatic switch to generate simultaneous curves representative of the respective application of each of the two components.

The foregoing description of an embodiment of the invention has been presented for purposes of illustration and description. It is not intended to be exhaustive or limit the invention to the precise form disclosed. Many modifications and variations, both as suggested and others, are possible in light of the above teaching. It is intended that the scope of the invention not be limited by the description and illustrations, but rather by the claims appended hereto.

What is claimed is:

1. A pneumatic switching apparatus for selectively connecting a component to an electrical circuit at a component mounting site comprising:

a housing;

a first pair of contacts mounted on said housing and spaced to enable engagement with said component mounting site on said electrical circuit;

a resilient vane within said housing;

flat conductor means connected to and extending respectively from said first pair of contacts, secured along said vane and connected respectively to a second pair of contacts which are supported on said vane;

said flat conductor means providing cantilevered support for said resilient vane;

a third pair of contacts supported within said housing which are in normally aligned, spaced relation respectively with said second pair of contacts;

a first electrical component electrically connected to said third pair of contacts; and selectively operable air delivery means extending into said housing with an outlet confronting the distal end of said resilient vane for causing said vane to be deflected, engaging said second pair of contacts respectively with said third pair of contacts, when air is delivered by said air delivery means, whereby said first electrical component is connected to said first pair of contacts.

2. The pneumatic switching apparatus of claim 1 wherein said cantilevered resilient vane has a turned end portion and the outlet of said selectively operable air delivery means is generally aligned with and coaxial with the resilient vane, whereby an air flow directed in the direction of the axis of the principal portion of said resilient vane impinges on the turned end portion to induce flexing of said vane.

3. The pneumatic switching apparatus of claim 1 wherein said second pair of contacts each present aligned contact surfaces at each side of said resilient vane and further comprising a fourth pair of contacts supported within said housing which are aligned respectively with said second pair of contacts; a second electrical component electrically connected to said fourth pair of contacts; and means normally biasing said resilient vane in one direction to engage said second pair of contacts respectively with said fourth pair of contacts; whereby said second electrical component is normally connected to said first pair of contacts and actuation of said selectively operable air delivery means causes said second electrical component to be disconnected from said first pair of contacts and said first electrical component to be connected to said first pair of contacts.

4. The pneumatic switching apparatus of claim 3 wherein the electrical connections between said first electrical component and said third pair of contacts are respectively equal in length to the electrical connections between said second electrical component and said fourth pair of contacts.

5. A pneumatic switching apparatus for selectively connecting a component to an electrical device at a component mounting site comprising:

a housing;

first and second external contacts mounted on said housing and spaced apart a distance to enable engagement with a component mounting site on an electrical device;

first and second socket means mounted on said housing for releaseably mounting electrical components;

switch means movable between a first position wherein a component mounted in said first socket means is electrically connected to said first and second electrical contacts and a second position wherein a component mounted in said second socket means is electrically connected to said first and second external contacts; and pneumatic means selectively operable for moving said switch means from said first position to said second position.

6. The pneumatic switching apparatus of claim 5 wherein said switch means includes a resilient vane and a pair of armature contacts carried by said vane and respectively connected to said first and second external contacts and said pneumatic means is operable to supply a flow of air which induces a flexing of said resilient vane which effects the movement of said switch means from said first position to said second position.

7. The pneumatic switching apparatus of claim 6 wherein said resilient vane is normally biased toward said switch means first position and movable to said switch means second position by actuation of said pneumatic means.

8. The pneumatic switching apparatus of claim 6 wherein said armature contacts each present contact surfaces at each side of said resilient vane and further comprises a first pair of connector elements connected to said first socket means at one end and respectively having a contact adjacent the opposite end confronting and aligned with said armature contacts; and a second pair of connector elements connected to said second socket means at one end and respectively having a contact adjacent the opposite end confronting and aligned with said armature contacts.

9. The pneumatic switching apparatus of claim 8 wherein said first pair of connector elements is positioned at one side of said resilient vane and said second pair of connector elements is positioned at the side of said resilient vane opposite said one side.

10. The pneumatic switching apparatus of claim 9 wherein the length of the electrical circuit paths from said first socket means to the said contacts at the opposite ends of said first pair of connector elements are respectively equal to the length of the electrical circuit paths from said second socket means to the contacts at the opposite ends of said second pair of connector elements, whereby said first and second socket means are selectively connectable to said first and second external contacts by electrical paths of equal length.

* * * * *